United States Patent [19]

Bron

[11] Patent Number: 4,818,830

[45] Date of Patent: Apr. 4, 1989

[54] PUSHPIECE MECHANISM FOR A TIMEPIECE

[75] Inventor: Alphonse Bron, Bassecourt, Switzerland

[73] Assignee: ETA SA Fabriques d'Ebauches, Grange, Switzerland

[21] Appl. No.: 32,802

[22] Filed: Apr. 1, 1987

[30] Foreign Application Priority Data

Apr. 9, 1986 [CH] Switzerland ..... 1389/86

[51] Int. Cl.[4] ..... H01H 3/12; G04C 9/00

[52] U.S. Cl. ..... 200/341; 200/431; 368/187; 74/110

[58] Field of Search ..... 200/275, 73, 76, 77, 200/340; 368/185, 187; 294/99.2; 254/28; 74/110, 483 PB, 10.33

[56] References Cited

U.S. PATENT DOCUMENTS 3,157,770 11/1964 Beaulieu ..... 200/275
3,243,562 3/1966 O'Brien ..... 200/275
3,489,874 1/1970 Baumann ..... 200/97
3,628,824 8/1969 Leuw ..... 294/99.2
4,035,596 7/1977 Marquardt ..... 200/76
4,451,719 5/1984 Lauterburg ..... 200/159 R

FOREIGN PATENT DOCUMENTS 624261 7/1981 Switzerland .

*Primary Examiner*—Henry J. Recla
*Assistant Examiner*—Linda J. Sholl
*Attorney, Agent, or Firm*—Griffin, Branigan & Butler

[57] ABSTRACT

The pushpiece mechanism for a timepiece comprises pushpiece return means arranged so that the force applied to the pushpiece passes through a maximum at an intermediate position thereof between a rest position and the pushed-in position of the pushpiece.

To this end the return means are provided with two bearing elements arranged to cooperate with one another and comprising respectively a beak and a heel coupled by an elastic member, such bearing elements and elastic member being formed as a single piece.

The mechanism may be applied in particular to electronic timepieces including a chronograph function.

8 Claims, 2 Drawing Sheets

PUSHPIECE MECHANISM FOR A TIMEPIECE

This invention concerns a control mechanism for a timepiece, in particular a chronograph including a pushpiece intended to take up a first rest position and a second pushed-in position and means for returning the pushpiece from the pushed-in position to the rest position, said mechanism being arranged so that the force applied to the pushpiece passes through a maximum at an intermediate position thereof.

BACKGROUND OF THE INVENTION

The pushpieces currently employed in connection with mechanical timepieces always act on a mechanism either to change an indication or to start or stop a special function, for instance a counting function (chronograph). Through the operation of a mechanism which passes from one state to another, there results a discontinuity or a brusque variation in the force exerted on the pushpiece by the user, this being manifested by a click generally audible accompanied by a clear perception to the touch of the variation of the force exerted. The user thus knows without it being necessary to make a visual inspection, that he was effectively brought about the concerned operation.

In the general run of electronic timepieces the functions are taken up by electronic circuits and their operation is brought about by means of simple contact switches controlled by the user by means of pushpieces. The previously employed mechanisms having become superfluous, the setting of the function is no longer determined with certainty by the user. He may thus experience doubts as to the effectiveness of the operation and has no other possibility than that of a visual inspection and even this possibility does not always exist. Such situation is further aggravated by any hesitation or trembling in the hand of the user. If he determines that his effort has not given rise to an effect, it is necessary to repeat it and again check the result. If his first control gesture were synchronized with an event serving as a point of departure for instance of a counting function, the effective operation does not correspond to this event and there will be an uncertainty as to the result of the measurement, such uncertainty depending on the reaction time of the user. This uncertainty is even more troublesome if, as is now very well known, one should wish to measure a time interval to the hundredth of a second, this being possible with electronic means without any intrinsic difficulties.

Attempts have been made to overcome these difficulties. For instance, Swiss Pat. No. 629.647 (US Pat. No. 4,451,719) discloses a pushpiece comprising a stem sliding in a tube against the return force of a spring in which pushpiece an elastic element is interposed between the stem and the tube. This element is axially retained in an accommodation arranged in the stem and cooperates with a surface borne by the tube, such surface exhibiting a sufficient variation in its slope in order that a click or decoupling is produced when the elastic member crosses over the change of slope. There results from what has just been said that the entire click mechanism is incorporated in the pushpiece, such complicating its construction and increasing its dimensions, above all in diameter, thus causing it to be poorly adapted to a thin chronograph.

Another attempt at overcoming the difficulties which have just been mentioned incorporates the click mechanism directly in the movement of the timepiece, such mechanism being then controlled by a pushpiece reduced to its most simple form. Such a construction is disclosed in the Japanese utility model JP No. 7 812/79 published Apr. 11, 1979. In this construction, a simple pushpiece acts on a spring mounted on the base plate of a timepiece movement. The spring maintains the pushpiece in its rest position. This spring includes a portion serving to fasten it to the base plate, an elastic portion, a portion in U form and finally an engaging portion serving to cooperate with a stud driven into the base plate. When the pushpiece passes from the rest position to the pushed-in position, the engaging portion butts initially against the stud, then climbs thereon, thus producing the click or decoupling effect sought after. This construction, in order to operate correctly, requires a very precise positioning of the stud driven into the base plate relative to the fixation point of the spring on said base plate. In this embodiment, the inevitable manufacturing tolerances will have as a result that the force applied to the pushpiece will vary over large limits as a function of such tolerances. Not only must the spring be cut out with precision, but further it must cooperate with fixed points which must be positioned with a tolerance which does not depend on the cutting of the spring, but on the implantation of such points fixed with reference ot the base plate. It will be likewise understood that in cases where the force of the disengagement is very high, the wear of the stud may be very rapid, which will bring about a diminution of such forces, indeed a shortened life of the pushpiece mechanism.

SUMMARY OF THE INVENTION

To overcome these difficulties, the click effect of the return means of the pushpiece according to the invention does not depend on the manner in which they are fixed onto the base plate or from their cooperation with elements forming a portion of this baseplate, but depends uniquely on the configuration of the return means themselves. To this effect they comprise two bearing elements arranged to cooperate with one another and coupled by an elastic member, said bearing elements and said elastic member being formed as a single piece.

Figure 1:
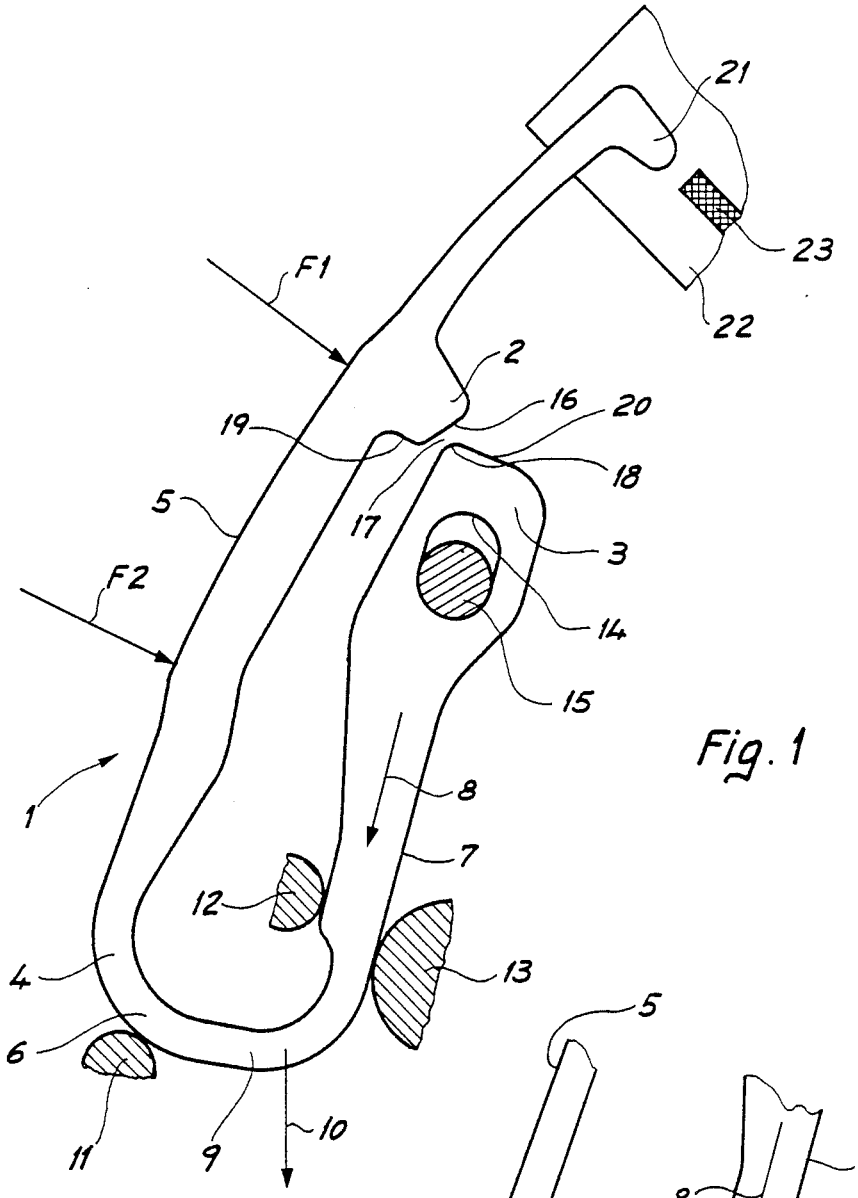
FIG. 1 is a plan view of the mechanism according to the invention and including return means comprised of two bearing elements coupled by an elastic member.
Figure 3:
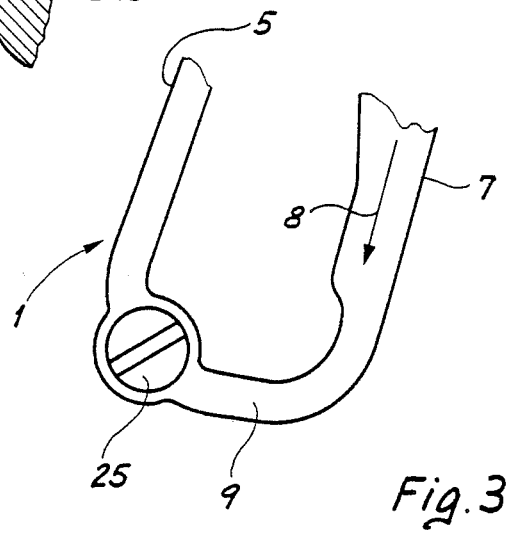

FIGS. *2a* to *2d* show how the bearing elements operate when the pushpiece pases from the rest position to the pushed-in position;

FIG. 3 shows a further embodiment of the invention derived from the arrangement shown in FIG. 1.

DESCRIPTION OF THE PREFERRED EMBODIMENT

FIG. 1 is a plan view of the mechanism according to the invention. This mechanism includes a pushpiece (not shown) but symbolized only by the force F1 applied thereby. Such pushpiece acts on the pushpiece return means 1 from a pushed-in position to a rest position. The return means include two bearing elements 2 and 3 and an elastic member 4 which couples together the bearing elements. FIG. 1 shows that the bearing elements 2 and 3 and the elastic member 4 are formed as a single piece. Such single piece may be cut out from a sheet of steel for instance. The bearing elements 2 and 3 are arranged to cooperate together in a manner which will be best explained with reference to FIGS. 2*a* to 2*d*. FIG. 1 shows the mechanism in the rest state when no force has been applied to the pushpiece.

In the particular example of FIG. 1, the return means 1 exhibit a generally U form. The first branch 5 of the U is pivoted at its base 6 and may flex angularly under the action of the pushpiece as exerted at F1. The second branch 7 of the U may slide elastically in its longitudinal sense (arrow 8) and this by bending of the thinned out base 9 of the U form which tends to displace such base in the sense of the arrow 10. According to the particular embodiment shown on FIG. 1, the first branch 5 is pivoted at its base 6 on a support 11 while the second branch 7 is guided in a slideway or guideway formed by elements 12 and 13. Finally, the bearing elements 3 includes an oblong aperture 14 in which penetrates a guide pin 15. The support 11, the slideway elements 12 and 13 and the pin 15 form part of the base plate of the timepiece movement on which rests spring 1. A plate (not shown) limits the play of the spring in the sense of the thickness of the timepiece. In another construction, the spring 1 is held in a sandwich between the base plate and a brace member formed for instance of plastic material, such brace member incorporating the supports 11, 12 and 13. The bearing element 2 exhibits the form of a beak having an inclined frontal plane 16 and the bearing element 3 exhibits the form of a heel shaped so as to cooperate with the beak.

With reference to FIG. 1 and FIGS. 2*a* to 2*d*, there will now be explained how the mechanism of the invention operates.

Figure 2A:
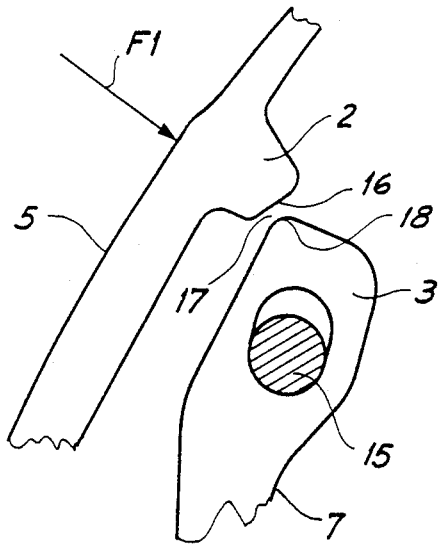
Figure 2B:
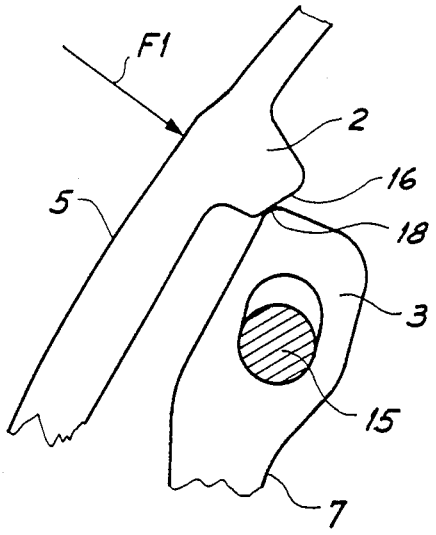
Figure 2C:
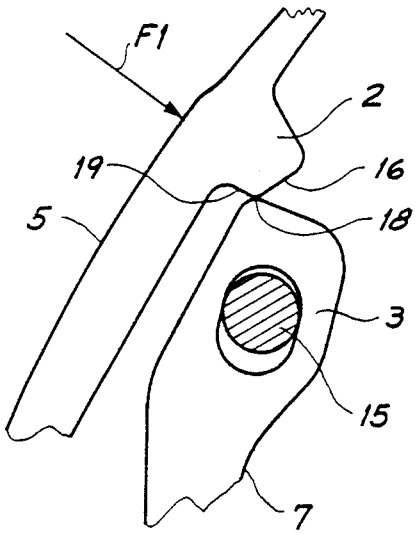
Figure 2D:
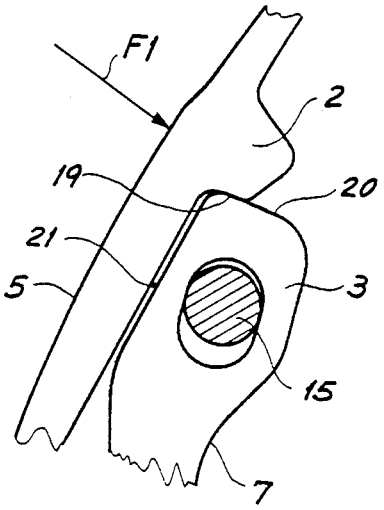

When no force is exerted on the pushpiece, beak 2 and heel 3 are separated from one another by a space 17 and the pushpiece occupies its rest position (FIG. 1 and 2*a*). When a force F1 is exerted on the pushpiece, branch 5 flexes angularly to the point where the inclined plane 16 of beak 2 comes into contact with a corner 18 of heel 3. The force exerted in this first phase is small, for instance 0.3 N (FIG. 2*b*). The position shown on FIG. 2*b* constitutes in some way a stop position from which it will be necessary to exert a much greater force should one wish to complete the pushing in movement of the pushpiece. This higher force, for instance, on the order of 8 N, causes the corner 18 of heel 3 to slide over the inclined plane 16 of beak 2 at the same time as the entire branch 7 yields longitudinally in the sense of the arrow 8 by flexing of the U form base 9 (FIGS. 1 and 2*c*). When the beak and the heel have attained the positions respectively shown on FIG. 2*c* and when one continues to act on the pushpiece, the lower edge 19 of beak 2 slides over the ridge 20 of heel 3 to the point where the branches of the U arrive in the position shown on FIG. 2*d*, which represents the end of the pushpiece course or the pushed-in position thereof. The position at the end of the pushpiece course could be that where branch 5 comes into contact with heel 3. However, to avoid overstressing the pin 15, it is preferred to have the pushpiece itself butt against the base plate which will leave a security clearance 21 between branch 5 and heel 3. Since the beak is no longer required to cause flexing of the U form elastic base 9 but only to overcome the frictional force of the edge 19 on the ridge 20, the force to be exerted on the pushpiece will diminish when the bearing elements 2 and 3 pass from the position shown on FIG. 2*c* to the position shown on FIG. 2*d*. This force for instance is on the order of 1 N.

The explanations which have just been given have shown that the force applied to the pushpiece passes through a maximum in an intermediate position of the course of said pushpiece and that the function sought after as described in the introduction is well fulfilled. This function however is dependent only on the return means 1 which have been obtained from a single piece and the precision of the operation which results therefrom will depend uniquely on the precision which is observed in obtaining this single piece, this presenting no major difficulty should the piece be cut out. In other words, the hard spot which is sought after depends on the form only of piece 1 and not to a stud being precisely located on the baseplate as was the case in the construction set forth in the Japanese utility model JP No. 7 812/79 cited hereinabove.

FIG. 1 shows further that the return means 1 include further an electric contact element 21 which acts for instance on the track 23 of a printed circuit 22. When branch 5 of the U is in the pushed-in position, the contact 21 closes an electrical circuit constituted by the U form element and track 23. FIG. 1 shows that the contact 21 is also obtained from one piece with the return means 1. It is constituted by an elongation of branch 5, such elongation being advantageously curved at the end of the beak and at the place of contact 21.

FIG. 1 further shows that considerable latitude is permitted as to the point of application of force F1 on branch 5. This point of application could be at F2 for instance or at any other point situated between F1 and F2. Thus the proposed construction does not require great precision as to the position of the pushpiece relative to branch 5, this simplifying the application of the system and rendering it more universal. At most there will be experienced slight differences in the force to be applied to the pushpiece according to the point of application of this force in order to fulfill the function required, such differences being due to the lever arm of the branch 5.

FIG. 3 is another embodiment of the invention derived from that which has just been discussed. Here the return means 1 in U form are no longer pivoted on a support, but rather about an axis formed by a screw 25 which goes through the U form piece. This manner of realization avoids the necessity of the slideway formed by the supports 12 and 13 which appear in the embodiment according to FIG. 1. The longitudinal guidance of branch 7 will always be brought about by means of the pin 15 and the oblong aperture 14 (see FIG. 1).

It is self-evident that the invention is not limited to the form of cut-out of the return means 1 shown on figure 1. Other forms could be envisaged, provided that the general concept as described hereinabove remains the same.

What I claim is:

1. A control mechanism for a chronograph including a pushpiece movable in response to an applied force from a first rest position to a second pushed-in position, and a pushpiece return means for returning the pushpiece from the pushed-in position to the rest position, wherein said pushpiece return means comprises two bearing elements arranged to cooperate with one another when a force is applied to said pushpiece, one of said bearing elements being arranged to bear against the other so that a force applied to the pushpiece to move said pushpiece from said rest position to said pushed-in position passes through a maximum at an intermediate position between said rest position and said pushed-in position, the maximum force occurring after said bearing elements bear against each other, and an elastic member, said bearing elements and said elastic member being formed as a single piece.

2. A control mechanism as claimed in claim 1 wherein said pushpiece return means further includes an electrical contact element for acting on an electrical circuit when the pushpiece is in said pushed-in position.

3. A control mechanism as claimed in claim 1 wherein said elastic member extends between said two bearing elements.

4. A control mechanism as claimed in claim 1 wherein said elastic member is connected between said two bearing elements and said single piece is generally U-shaped and open at one side.

5. A control mechanism for a chronograph including a pushpiece movable in response to an applied force from a first rest position to a second pushed-in position, and a pushpiece return means for returning the pushpiece from the pushed-in position to the rest position, wherein said pushpiece return means comprises two bearing elements arranged to cooperate with one another so that a force applied to the pushpiece to move said pushpiece from said rest position to said pushed-in position passes through a maximum at an intermediate position between said rest position and said pushed-in position, and an elastic member, said bearing elements and said elastic member being formed as a single piece, said pushpiece return means including first and second branches connected by a base element in a generally U-shaped configuration, said first branch being pivoted at its base and adapted to flex angularly upon movement of said pushpiece, said second branch being capable of sliding elastically in its longitudinal direction as said base element flexes, said first and second branches including a beak and heel, respectively, forming said bearing elements, said beak and heel being conformed one to the other such that the beak successively bears on the heel, causes it to yield, and slides thereover as the pushpiece is moved from the first rest position to the second pushed-in position.

6. A control mechanism as claimed in claim 5 and further comprising a support, said first branch being pivoted at its base on said support; a guideway, said second branch being guided in said guideway; and, a guide pin, said heel including an oblong aperture into which said guide pin extends.

7. A control mechanism as claimed in claim 5 and further comprising a pivot, said first branch being pivoted on said pivot at its base about an axis extending therethrough, and a guide pin, said heel including an oblong aperture into which said guide pin extends.

8. A control mechanism as claimed in claim 5 wherein said break comprises a frontally inclined plane which bears against said heel to form therewith a stop defining said intermediate position at which the force applied to said pushpiece is said maximum.

* * * * *